United States Patent [19]

Greenspan

[11] 4,114,322

[45] Sep. 19, 1978

[54] ABRASIVE MEMBER

[76] Inventor: Harold Jack Greenspan, 5334 Holt Ave., Los Angeles, Calif. 90056

[21] Appl. No.: 821,232

[22] Filed: Aug. 2, 1977

[51] Int. Cl.[2] ..... B24D 5/02; B24D 7/02

[52] U.S. Cl. ..... 51/206 R; 51/209 R; 175/379

[58] Field of Search ..... 51/204, 206 R, 209 R, 51/209 DL, 209 S, 395; 175/379

[56] References Cited

U.S. PATENT DOCUMENTS

| | | | |
|---|---|---|---|
| 888,129 | 5/1908 | Tone | 51/209 R X |
| 2,229,019 | 1/1941 | Van Der Pyl | 51/209 R |
| 2,246,362 | 6/1941 | Kehoe | 51/209 R |
| 2,633,682 | 4/1953 | Jackson | 51/206 R |
| 2,820,746 | 1/1958 | Keeleric | 51/209 S X |
| 3,145,511 | 8/1964 | Bird | 51/206 R |
| 3,869,263 | 3/1975 | Greenspan | 51/209 R |

*Primary Examiner*—Gary L. Smith
*Attorney, Agent, or Firm*—James E. Brunton

[57] ABSTRACT

An abrasive member providing a working surface characterized by having a multiplicity of upstanding angularly extending ridges. Particles of an abrasive material, such as diamond, are affixed to the ridges in a manner so that as the tops of the ridges wear down, fresh particles of the abrasive material will become reembedded therein, thereby continually presenting a fresh cutting surface.

8 Claims, 12 Drawing Figures

ABRASIVE MEMBER

BACKGROUND OF THE INVENTION

1. Field of the Invention

The present invention relates generally to abrasive members used for cutting, polishing, and grinding applications. More particularly, the invention relates to abrasive members having a uniquely configured working surface which tends to continually revitalize itself during use.

2. Discussion of the Prior Art

Various types of abrasive members have been suggested for cutting, polishing, and grinding operations. Typically, these members embody abrasive particles such as diamond dust which are bonded, or otherwise affixed, onto flat working surfaces. The drawback of such devices is that during use the cutting edges of the abrasive particles, which project outwardly from the working surface, rapidly become dull and lose their cutting ability.

One of the most successful abrasive members to be devised for overcoming the drawbacks of the prior art devices is described in my U.S. Pat. No. 3,869,263. The present invention is an improvement upon the abrasive members therein described. Applicant is also aware of U.S. Pat. No. 3,495,359 to Smith et al. As will become clear from the description which follows, the embodiments of the present invention constitute significant improvements over the prior art devices. The abrasive members of the present invention provide a uniquely configured working surface comprising a multiplicity of generally parallel upstanding ridges upon which the abrasive particles are affixed. Because of the configuration of these ridges, the way in which the abrasive particles are affixed thereto, and their wear characteristics, the working surface is continually revitalized by abrasive particles being reembedded therein.

SUMMARY OF THE INVENTION

It is an object of the invention to provide an improved abrasive member for use in grinding, cutting, and polishing operations in which particles of abrasive material such as diamonds are partially embedded into a working surface characterized by having a multiplicity of substantially parallel upstanding ridges extending at an angle with respect to a line parallel to the direction of advance of the working surface relative to the face of the work piece.

It is another object of the invention to provide an abrasive member of the aforementioned character in which the ridges provided on the working surface are constructed of a wearable material and are uniquely configured and arranged so that as they wear down and the abrasive particles affixed thereto become dull, the particles affixed to the sides of the ridges will loosen and will tend to become reembedded into the upper surfaces of the ridges thereby continually providing a fresh material cutting surface.

It is another object of the invention to provide an abrasive member of the aforementioned character in which the abrasive particles are held in position on the working surface by a metallic coating, such as nickel uniformly deposited upon the working surface.

It is another object of the invention to provide an abrasive member of the aforementioned character which can easily be mounted for rotation upon the spindle of various types of power tools.

It is still another object of the invention to provide an abrasive member of the type described in the preceeding paragraphs which is configured in a variety of useful shapes including a ring wheel, a core drill, and a cylindrically shaped mandrel.

It is another object of the invention to provide an abrasive member of the class described which has superior grinding, cutting, and polishing characteristics, is durable in use, always providing a fresh cutting surface, is easy to use, and is inexpensive to manufacture.

In summary, these and other objectives of the invention are realized by an abrasive member for grinding, cutting and polishing a work piece, comprising a rigid base member having a wearable working surface provided with a multiplicity of upstanding, substantially parallel ridges each having sloping side walls and a concave top surface; and a multiplicity of abrasive particles fixedly positioned relative to said working surface so that at least portions thereof extend outwardly from said side walls and said top surfaces of said ridges.

DESCRIPTION OF THE INVENTION

Figure 1:
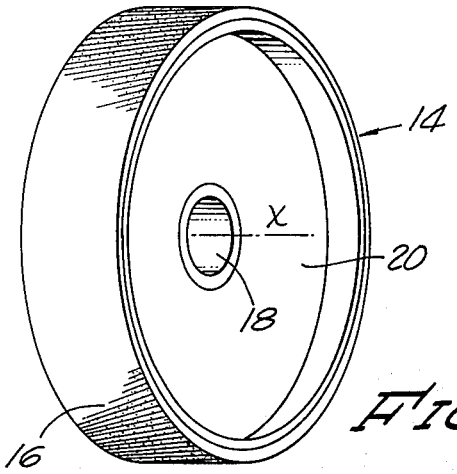
FIG. 1 is a perspective view of the abrasive member of one form of the invention in which the member is generally ring shaped with the working surface being provided about the periphery thereof.
Figure 2:
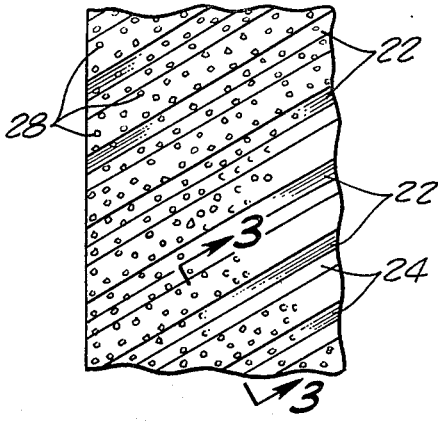
FIG. 2 is an enlarged fragmentary view of a portion of the working surface of FIG. 1.

Referring to the drawings, FIGS. 1–4 show one embodiment of the abrasive member of the invention for use in grinding, cutting and polishing operations on a work piece. As best seen in FIG. 1, the abrasive member of this form of the invention comprises a rigid wheel-shaped base member 14 having a rim 16, a hub 18, and a web 20 interconnecting the hub and the rim. This member, sometimes called a ring wheel, is adapted to be rotatably mounted on the spindle of a power tool such as a grinder and has a transverse axis X about which it rotates. In this embodiment, the wearable working surface of the abrasive member is provided on the rim 16 and comprises a multiplicity of generally parallel ridges 22 (FIG. 2) extending across the working surface at an acute angle of about 30° with respect to a line parallel to the axis of rotation X of the base member 14.

Figure 3:
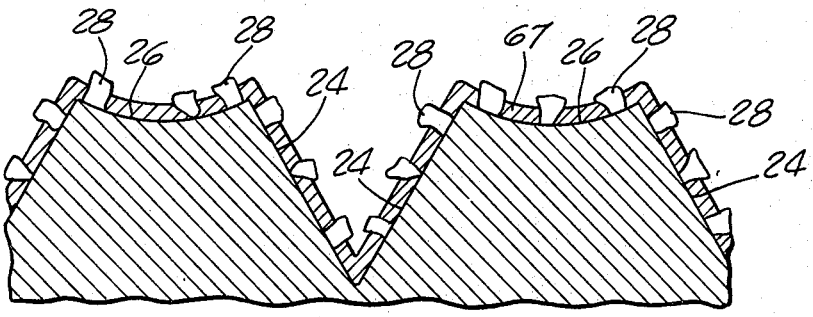
FIG. 3 is a greatly enlarged cross-sectional view of the working surface of the abrasive member taken along line 3—3 of FIG. 2.

Referring particularly to FIG. 3, each of the parallel ridges 22 can be seen to have sloping side walls 24 and a concave top surface 26. A multiplicity of abrasive particles 28 are fixedly positioned on the side walls 24 and top portion 26 of each ridge 22 so that at least portions of the particles extend outwardly therefrom. Although various types of abrasive material have proved satisfactory depending upon the end use to be made of the device, diamond, boron nitride, and aluminum oxide have been found highly satisfactory for abrasive devices, and particularly for those used in lapidary endeavors.

Figure 4:
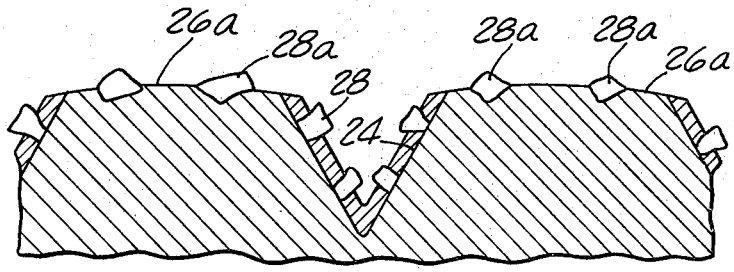
FIG. 4 is a cross-sectional view similar to FIG. 3 but showing the appearance of the working surface after it has been worn due to use and the repositioning or reembedding of the abrasive particles into the upper surface of the ridges which comprise the working surface.
Figure 5:
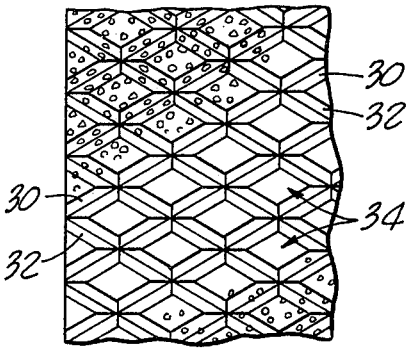
FIG. 5 is an enlarged fragmentary plan view of the working surface of another form of abrasive member of the invention.
Figure 6:
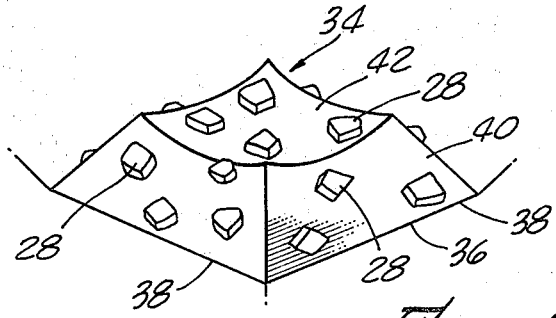
FIG. 6 is a greatly enlarged fragmentary view illustrating the configuration of the working surface of the embodiment of the invention shown in FIG. 5.

In FIGS. 5 and 6 there is illustrated another form of abrasive member of the present invention. This form of the invention is similar to that illustrated in FIGS. 1–4, but as best seen in FIG. 5, comprises a working surface 16 having first and second sets of crossing ridges 30 and 32 extending substantially across the working surface. Ridges 30 and 32 form an acute angle with respect to a line parallel to the axis of rotation of the base member 14. As shown in FIG. 5, the ridges define an angle at their intersection of approximately 60° and an angle with respect to a line parallel to the axis of rotation of the base member of on the order of 30°. While the ridges 30 and 32 may be formed at various angles with respect to the axis of rotation of the base member, the angles shown in the drawing have proved quite satisfactory, particularly for ring wheels used in lapidary endeavors.

As best seen by referring to FIG. 6, the protuberances defined by the intersecting ridges 30 and 32 (shown in plan in FIG. 5 and shown in greatly enlarged perspective in FIG. 6), have a unique upstanding configuration. Each protuberance, generally designated by the numeral 34 in FIG. 6, has a polygonal base 36, the sides 38 of which form the base of foreshortened triangular surfaces 40. These foreshortened surfaces meet at a common concave-shaped vertex 42. Abrasive particles 28 of the type previously described are uniformly affixed to the side and top surfaces of the protuberances 34.

Figure 7:
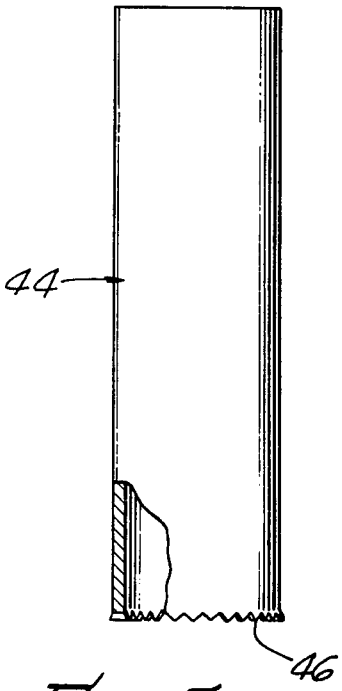
FIG. 7 is a side view, partly broken away, of another embodiment of the abrasive member of the invention.
Figure 8:
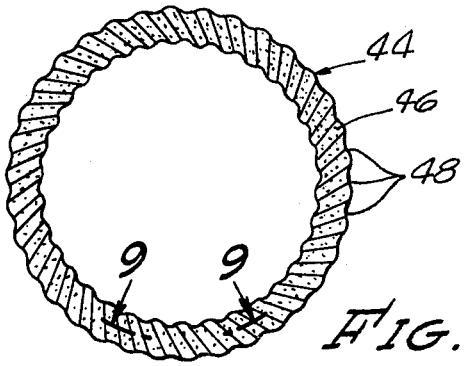
FIG. 8 is an enlarged end view of the abrasive member illustrated in FIG. 7.
Figure 9:
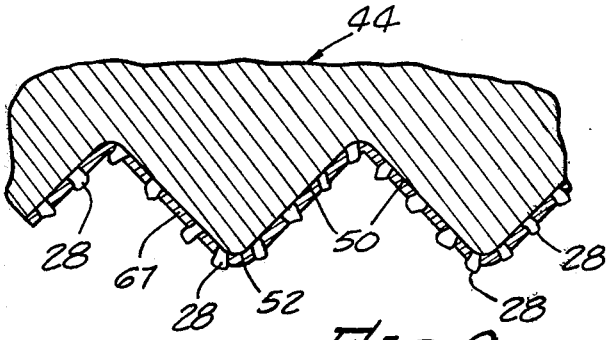
FIG. 9 is a greatly enlarged cross-sectional view taken along lines 9—9 of FIG. 8 and showing the configuration of the working surface of this form of the invention.

Turning now to FIGS. 7–9 there is illustrated still another form of the abrasive member of the invention. In this embodiment the base member comprises a hollow cylinder 44 having at least one planar end 46. As best seen in FIGS. 8 and 9, a multiplicity of upstanding substantially parallel ridges 48 extend across the planar surface 46 at an angle relative to a line perpendicular to the longitudinal axis of the base member 44. As shown in FIG. 9, ridges 48 have sloping side walls 50 and a curved top surface 52. As in the earlier described embodiments, a multiplicity of abrasive particles 28 are fixedly positioned relative to the working surface so that at least portions thereof extend outwardly from the side walls and top surfaces of the ridges 48. The abrasive member of this form of the invention can be used for a variety of grinding and cutting operations but it is particularly well suited for use as a core drill in lapidary work.

Figure 10:
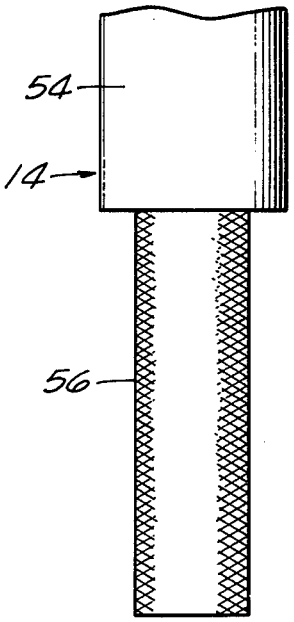
FIG. 10 is a side view of another form of abrasive member of the invention.
Figure 11:
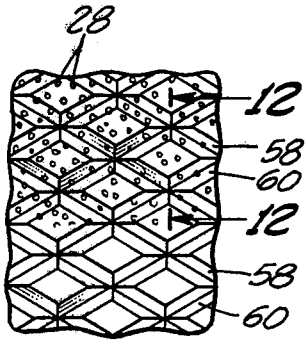
FIG. 11 is an enlarged fragmentary view of the working surface of the abrasive member illustrated in FIG. 10.
Figure 12:
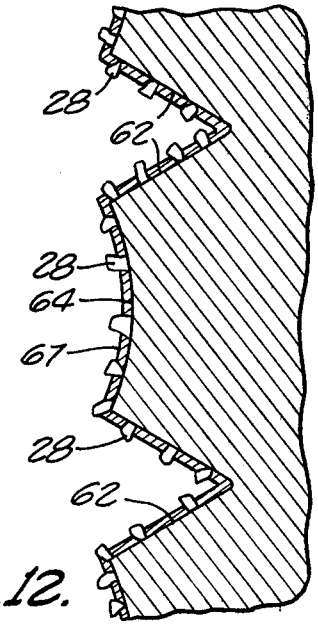
FIG. 12 is a greatly enlarged cross-sectional view taken along lines 12—12 of FIG. 11.

Referring to FIGS. 10–12, there is illustrated yet another form of abrasive member of the present invention. In this embodiment, the base member 14 is generally cylindrical having a body portion 54 and a shank portion 56. Shank portion 56 is provided with at least one set of upstanding substantially parallel ridges, each having sloping side walls and a curved top surface. In the form of the invention shown in FIGS. 10 and 11, the working surface comprises a plurality of intersecting ridges 58 and 60 (FIG. 11) extending about the periphery of the shank portion 56. These intersecting ridges form a multiplicity of protuberances of the type previously described in connection with FIGS. 5 and 6. As best seen by referring to FIG. 12, where the protuberances are shown in cross section, each has sides in the form of foreshortened triangular surfaces 62 which meet at a common concave-shaped vertex 64. A multiplicity of abrasive particles 28 of the type earlier described are fixedly positioned relative to the working surface so that portions thereof extend outwardly from the surfaces of the protuberance.

In each of the forms of the abrasive member of the invention shown in the drawings, the working surface is constructed of a soft, but tough and comparatively ductile material such as steel or copper which is wearable under operating conditions. When a material such as copper is used, the working surface wears rapidly. When, on the other hand, steel is used, the working surface wears more slowly. Selection of other types of metals would, of course, provide varying degrees of wear and cutting speeds.

In each embodiment of the invention, as previously described, there is provided a particle bonding material 67 which forms a part of the working surface 14. This bonding material serves to hold the abrasive particles 28 in place on the working surface. Preferably the abrasive particles are uniformly spaced apart over the entire working surface and are embedded or encapsulated in the bonding material so that a portion of their jagged or cutting edges projects outwardly from the working surface. Various types of particle bonding material have proven satisfactory. For example, good results have been obtained using a metal bonding material such as nickel which can be deposited onto the working surface of the part by vapor deposition or other plating techniques. Such a coating serves to effectively encapsulate the abrasive particles and to securely hold them in position on the working surface. For certain applications other adhesive materials such as epoxy resins can also be used as the bonding material.

The unique configuration and composition of the working surfaces of the various forms of the invention, coupled with the manner in which the abrasive particles are affixed to the working surfaces, provides a highly novel and unique abrasive member, the working surface of which is continually revitalized during use. This revitalizing feature is illustrated in FIG. 4 wherein the appearance of the worndown working surface is depicted. As seen in FIG. 4, as the surface shown in FIG. 3 wears down due to use, the concave top portions of the ridges or protuberances become rounded substantially in the manner illustrated. As these top portions wear, the abrasive particles 28 which are affixed to the side walls and top surfaces loosen and, because of the angle and configuration of the ridges and protuberances, become reembedded in the worn top surfaces. For example, the abrasive particles designated by the numeral **28*a* in FIG. 4 are meant to depict particles which had previously been affixed to the working surface, had become loosened during use, and now have become reembedded into the upper portion of the working surface designated as 26a in FIG. 4. These particles 28a** present sharp cutting surfaces which tend to revitalize the cutting efficiency of the abrasive member. This revitalization of the working surface continues so long as abrasive particles remain on the side walls of the ridges or protuberances.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An abrasive member comprising:

(a) a rotatable wheel-shaped base member having a rim and a hub, said member being adapted to rotate about a transversely extending axis;

(b) a wearable working surface provided on said rim, said working surface comprising a multiplicity of ridges extending thereacross at an acute angle of about 30° with respect to a line parallel to the axis of rotation of said base member; said ridges having sloping side walls terminating in a concave upper surface, and;

(c) a multiplicity of diamond particles bonded to said side walls and upper surfaces of said ridges so that at least portions thereof extend outwardly therefrom.

2. An abrasive member as defined in claim 1 in which said working surface is provided with first and second sets of crossing ridges extending substantially thereacross, said crossing ridges defining an angle therebetween of approximately 60°.

3. An abrasive member comprising:

(a) a base member having a wearable working surface provided with a multiplicity of upstanding protuberances each having a polygonal base the sides of which form the bases of foreshortened triangular surfaces meeting at a common concave shaped vertex; and (b) a multiplicity of abrasive particles fixedly postioned relative to said working surface so that portions thereof extend outwardly from said triangular surfaces of said protuberances.

4. An abrasive member as defined in claim 3 in which said base member is wheel shaped having a hub and a rim, said working surface being provided on said rim.

5. A rotatable abrasive member for use in grinding, cutting and polishing the face of a work piece, by advancing the member relative to the face thereof, comprising:

(a) a rigid base member having a wearable working surface formed of a metal, said working surface being provided with a plurality of upstanding ridges each of said ridges extending at an angle with respect to a line parallel to the direction of advance of the member relative to the face of the work piece and each of said ridges having sloping side walls and a concave top surface; and (b) a multiplicity of particles of an abrasive material partially embedded in said working surface in a manner so that at least portions thereof extend outwardly from said side walls and said top surfaces of said ridges and so that as said working surface wears said particles will loosen.

6. An abrasive member as defined in claim 5 in which said base member is generally wheel shaped with said wearable working surface extending about the periphery thereof.

7. An abrasive member as defined in claim 5 in which said base member is generally cylindrical having a body portion and a shank portion said working surface being provided on the exterior of said shank portion.

8. An abrasive member as defined in claim 5 in which said base member is in the form of a hollow cylinder having at least one planar end, said working surface being provided on said planar end.

* * * * *